United States Patent [19]

Harumoto et al.

[11] Patent Number: 4,581,477

[45] Date of Patent: Apr. 8, 1986

[54] GAS-INSULATED ELECTRICAL APPARATUS

[75] Inventors: Yoshinobu Harumoto, 6-5-13, Toyono-cho Tokiwa-dai, Toyono County, Osaka; Yoshio Yoshida, 8, Sakuraga-oka 3-chome, City of Minoo, Osaka; Yuichi Kabayama, 18-5, Fujigao 6-chome, City of Katano, Osaka; Tetsuro Hakata, Ako; Takahiro Matsumoto, Ako; Tsugio Watanabe, Ako, all of Japan

[73] Assignees: Yoshinobu Harumoto; Yoshio Yoshida; Yuichi Kabayama; Mitsubishi Denki Kabushiki Kaisha, all of Japan

[21] Appl. No.: 596,844

[22] Filed: Apr. 4, 1984

[30] Foreign Application Priority Data

Apr. 5, 1983 [JP] Japan ..... 58-60593
Jun. 1, 1983 [JP] Japan ..... 58-97620

[51] Int. Cl.[4] ..... H01B 7/34

[52] U.S. Cl. ..... 174/15 R; 165/104.27; 336/57

[58] Field of Search ..... 174/15 R; 336/55, 57, 336/58; 165/104.27, 104.33

[56] References Cited

U.S. PATENT DOCUMENTS

| | | | |
|---|---|---|---|
| 2,961,476 | 11/1960 | Maslin et al. | 165/104.33 X |
| 3,243,495 | 3/1966 | Mazza | 174/15 R |
| 3,371,298 | 2/1968 | Narbut | 336/57 |
| 3,444,308 | 5/1969 | Narbut | 174/15 R |
| 3,526,270 | 9/1970 | Norton | 165/104.27 X |
| 4,117,525 | 9/1978 | Moore | 336/57 X |

*Primary Examiner*—A. T. Grimley
*Assistant Examiner*—Morris H. Nimmo
*Attorney, Agent, or Firm*—Leydig, Voit & Mayer, Ltd.

[57] ABSTRACT

The invention is relative with a gas-insulated electrical apparatus comprising a tank housing an electrical apparatus proper and in which a gas mixture consisting of a noncondensable insulating gas and a condensable refrigerant gas and a liquid phase of the condensable refrigerant gas are sealed, and a gas reservoir connected to said tank in the gas mixture feeding or receiving relation therewith. According to the invention, means are provided between the tank and the gas reservoir for selectively supplying said gas mixture from said tank into said gas reservoir or vice versa.

7 Claims, 8 Drawing Figures

GAS-INSULATED ELECTRICAL APPARATUS

BACKGROUND OF THE INVENTION

This invention relates to a gas-insulated electrical apparatus and, more particularly, to such apparatus in which a noncondensable insulating gas, a condensable cooling medium or refrigerant gas and a liquid phase converted from said refrigerant gas are sealed in a tank housing an electrical apparatus proper such as transformer and in which the electrical apparatus proper is simultaneously insulated and cooled through evaporation of the condensable refrigerant gas.

The apparatus of the type known in the art is shown in FIG. 1 wherein a gas-insulated transformer 1 is shown by way of an example. The transformer 1 having a winding 1*a* and an iron core 1*b* is contained in a tank 2 in which a gas mixture 3 composed of a non-condensable gas and a condensable gas and a liquid phase 4 of the condensable gas is sealed hermetically. The function of the gas mixture 3 is to cool the winding 1*a* and the iron core 1*b* and maintain the insulation of the winding 1*a*. A cooling unit 5 is connected to the tank 2 for cooling the transformer 1. A spray nozzle 6 is mounted right above the transformer 1 within the tank 2 for spraying liquid phase 4 towards transformer 1 through a piping 7 and a pump 8. A gas reservoir 10 is connected to the tank 2 through a gas suction valve 9 and through a compressor 11, piping 12 and a gas discharge valve 13. A control unit 14 is used for controlling the operation of a pressure sensor 15 mounted to the tank 2, the compressor 11, the gas suction valve 9 and the gas discharge valve 13.

In operation, upon starting the transformer 1, the gas mixture 3 and the liquid phase 4 are heated by heat evolved from transformer 1, resulting in an increased gas pressure within tank 2. The gas pressure in excess of a preset upper limit may destruct the tank 2. For avoiding such trouble, gas pressure in the tank 2 is sensed by a pressure sensor 15. Depending on the thus sensed gas pressure, the gas discharge valve 13 is opened under control of the unit 14 for discharging excess gas mixture 3 into gas reservoir 10. When the load connected to the transformer 1 is lowered, the temperature of the gas mixture 3 and the liquid phase 4 is lowered, resulting in the lowered pressure of the gas mixture 3. Such decrease in the gas pressure means a decrease in the dielectric strength of the winding 1*a*. For avoiding such decrease in the dielectric strength of the winding 1*a*, the gas pressure in tank 2 lower than a preset lower limit is sensed by pressure sensor 15. By the operation of the control unit 14, gas suction valve 9 is opened and the compressor 11 driven in operation for conveying the mixed gas under pressure from the gas reservoir 10 into the tank 2.

The gas pressure in the tank 2 may be maintained in this manner within a range between the preset upper and lower limit values. However, in the aforementioned prior-art device, it is not possible to elevate the gas pressure in the gas reservoir 10 to a value higher than that in the tank 2. The result is the narrow control range of the gas pressure in the reservoir 10. It is, moreover, required that the gas reservoir 10 be increased in size if it is desired to maintain a preset gas storage capacity of the reservoir.

FIG. 2 shows another example of the prior art in which a compressor 11*a* and a control valve 18 controlled by a pressure senser 20 and another control valve 16 controlled by a level gauge 22 in a gas reservoir 10*a* are provided between the gas reservoir 10*a* and the tank 2 in which the transformer 1 is housed and the gas mixture 3 and the liquid phase 4 are sealed. The numerals 17, 19 denote piping.

In operation, when the transformer 1 is started and the gas pressure in the tank 2 has exceeded the preset upper values under the effect of heat evolved from transformer 1, control valve 18 is opened by signals from pressure sensor 20 and the compressor 11*a* is driven into operation for conveying the gas mixture 3 under pressure from the tank 2 into the gas reservoir 10*a*. When the load connected to the transformer 1 is lowered and thus the heat evolved from transformer 1 decreased so that the gas pressure within the tank 2 becomes lower than a preset lower value, control valve 16 is opened by signals supplied from the pressure sensor 21 for discharging the gas mixture from the gas reservoir 10*a* into the tank 2. Also, when the condensable gas in the gas mixture condenses and liquefies in the reservoir 10*a*, and the liquid phase thus formed rises to higher than a preset level, such condition is sensed by level gauge 22 so that the control valve 16 is similarly opened for returning the liquid phase 4 in the reservoir 10*a* into tank 2.

The gas pressure in the tank 2 can be maintained in this manner within the preset pressure range. However, in this case, the gas pressure in the reservoir 10 cannot be reduced to lower than the gas pressure in the tank 2, contrary to the example shown in FIG. 1, so that the pressure control range in the gas reservoir 10*a* cannot be enhanced as desired and only a small amount of the gas can be stored in the reservoir.

SUMMARY OF THE INVENTION

With the foregoing in view, it is a principal object of the present invention to provide a gas-insulated electrical apparatus in which the pressure control range in the gas reservoir and the amount of gas storage can be enhanced.

The present invention resides in the apparatus of the above type in which means are provided between the tank and the gas reservoir for selectively conveying the gas mixture under pressure from the tank towards the gas reservoir and vice versa.

DESCRIPTION OF THE PREFERRED EMBODIMENTS

Figure 1:
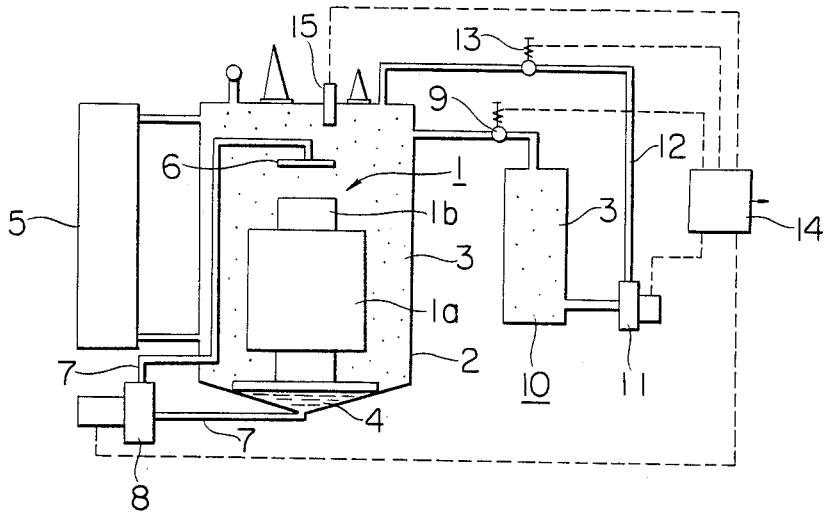
FIG. 1 PRIOR ART
FIG. 1 is a diagrammatic view of a prior-art device.
Figure 2:
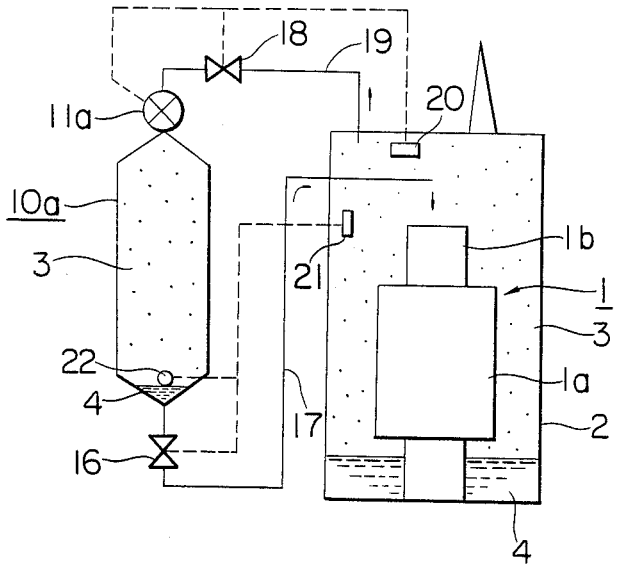
FIG. 2 PRIOR ART
FIG. 2 is a diagrammatic view of another prior-art device.
Figure 3:
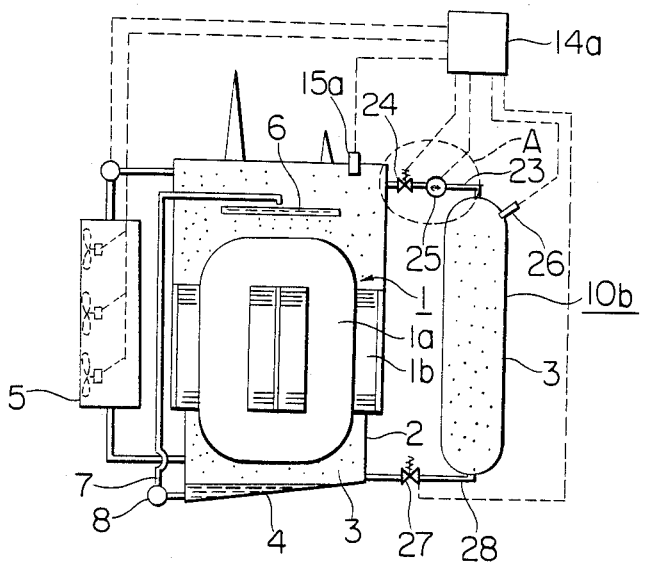
FIG. 3 is a diagrammatic view of a device embodying the present invention.

FIG. 3 shows an embodiment of the present invention. A compressor 25 and a control valve 24 are mounted in a piping 23 between a gas reservoir 10*b* on one hand and a transformer 1 and a tank 2 on the other. The compressor 25 may be reversed in the rotational direction so that the gas mixture 3 and the liquid phase 4 of the condensable gas contained in the tank 2 may be selectively forwarded under pressure from the tank 2 towards gas reservoir 10*b* and vice versa. A control unit 14*a* operates to control the control valve 24, the compressor 25 and a control valve 27 to be later described by control signals received from a pressure sensor 15*a* placed in tank 2 and from a pressure senser 26 placed in gas reservoir 10*b*. The lower parts of the tank 2 and the gas reservoir 10*b* are interconnected by a bypass pipe 28 in which the control valve 27 is placed as shown. The cooling unit 5, the spray nozzle 6 for the liquid 4 and the piping 7 used therefor are the same as those shown in FIG. 1.

The device so far shown and described operates as follows.

As the transformer 1 is started or the load connected to the transformer increased, more heat is evolved from the transformer 1, so that the temperature of the mixed gas 3 and liquid 4 and the gas pressure in the tank 2 are increased. When the gas pressure exceeds a preset upper limit, such condition is sensed by the pressure sensor 15*a*. At this time, the gas pressure in the gas reservoir 10*b* is sensed by the pressure senser 26. When the gas pressure in the tank 2 is higher than that in the gas reservoir 10*b*, the control valve 27 is opened by operation of the control unit 14*a* for discharging an excess of gas mixture 3 from the tank 2 into the gas reservoir 10*b* and maintaining the gas pressure in the tank 2 to be lower than the preset upper value. On the other hand, when the gas pressure in the tank 2 exceeds the preset upper value, as mentioned above, and the gas pressure in the tank 2 is lower than that in the gas reservoir 10*b*, the compressor 25 is started, at the same time that the control valve 24 is opened by the operation of the control unit 14*a*, so that the gas mixture 3 is forwarded under pressure from tank 2 into gas reservoir 10*b* for maintaining the gas pressure in the tank 2 to be lower than the preset upper value.

On the contrary, when the load connected to the transformer 1 is lowered and lesser heat evolved from the transformer 1, the gas temperature being lowered and the gas pressure in the tank 2 being lowered to lesser than the preset lower value, such condition is sensed by the pressure senser 15*a*. When the gas pressure in the gas reservoir 10 as sensed by pressure senser 26 is higher than that in the tank 2, the control valve 27 is opened by the operation of the control unit 14*a* for introducing a required amount of the gas mixture 3 from the gas reservoir 10*b* into the tank 2 for maintaining the gas pressure in tank 2 to be higher than the preset lower value, and returning the condensed liquid 4 in the gas reservoir 10*b* towards tank 2. When the gas pressure in tank 2 is lower than the preset lower value, as mentioned above, and the gas pressure in tank 2 is higher than that in the gas reservoir 10*b*, the control valve 24 is opened by the operation of the control unit 14*a*, while the compressor 25 is started in the opposite direction for conveying the gas mixture 3 under pressure from the gas reservoir 10*b* into the tank 2 in required amounts for maintaining the gas pressure in the tank 2 to be higher than the preset lower value.

In this manner, a wide range of the gas pressure in the gas reservoir 10*b* extending from a zone higher than the gas pressure in the tank 2 to one lower than such gas pressure may be used so that the gas pressure in the reservoir 10*b* can be adjusted over a wider range than is possible with the conventional system. This means that the gas reservoir 10*b* may be reduced in size as desired.

Figure 4:
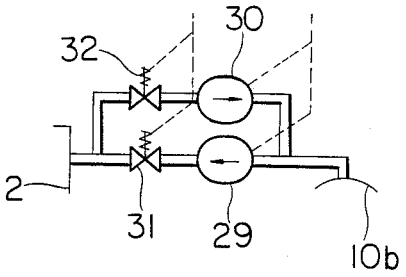
FIG. 4 is a partial view showing an alternative construction of a portion A shown in FIG. 3.

FIG. 4 shows an alternative construction of a portion A shown in FIG. 3. A first compressor 29 is used for conveying the mixed gas under pressure from the gas reservoir 10*b* towards tank 2 and a second compressor 30 is used for conveying the gas under pressure from the tank 2 towards the gas reservoir 10*b*. Control valves 31, 32 are associated with the compressors 29, 30, respectively, as shown.

When the two compressors 29, 30 are used for conveying the gas under pressure in one direction only, the control valve 32 is opened and the associated compressor 30 driven in operation for conveying the gas mixture under pressure from the tank 2 towards the gas reservoir 10*b*, while the control valve 31 is opened and the associated compressor 29 driven in operation for conveying the gas mixture from the gas reservoir 10*b* towards the vessel 2, for the effects similar to those obtained in the preceding embodiment.

Figure 5:
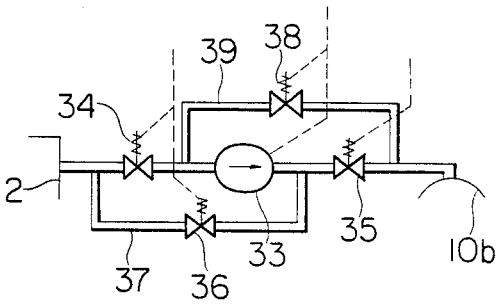
FIG. 5 is a partial view showing another alternative construction of the portion A shown in FIG. 3.

FIG. 5 shows a further alternative construction of the portion A shown in FIG. 3. A compressor 33 adapted for conveying the gas mixture in one direction is connected via control valves 34, 35 to tank 2 and gas reservoir 10*b*, respectively. A bypass piping 37 having a control valve 36 is provided between a point intermediate the compressor 33 and the control valve 35 and a point intermediate the control valve 34 and tank 2. Similarly, another bypass piping 39 having a control valve 38 is provided between a point intermediate the control valve 34 and the compressor 33 and a point intermediate the control valve 35 and the reservoir 10*b*.

When the gas mixture is to be forwarded from tank 2 into the gas reservoir 10*b*, the control valves 34, 35 are opened and the control valves 36, 38 closed, while the compressor 33 is driven in operation. When the gas mixture is to be conveyed from the gas reservoir 10*b* into the tank 2, the compressor 33 is driven in operation with the control valves 34, 35 being closed and the control valves 36, 38 open, for achieving the similar effects.

In the above described embodiments of the present invention, in controlling the gas pressure in the tank 2, gas pressures are sensed by pressure sensors 15*a*, 24 and the resulting output signals therefrom are used for controlling the operation of the compressor and control valves. However, in view of a certain correlation between the gas pressure and the gas temperature, temperature sensors may also be used in place of the pressure sensors for achieving similar effects.

Figure 6:
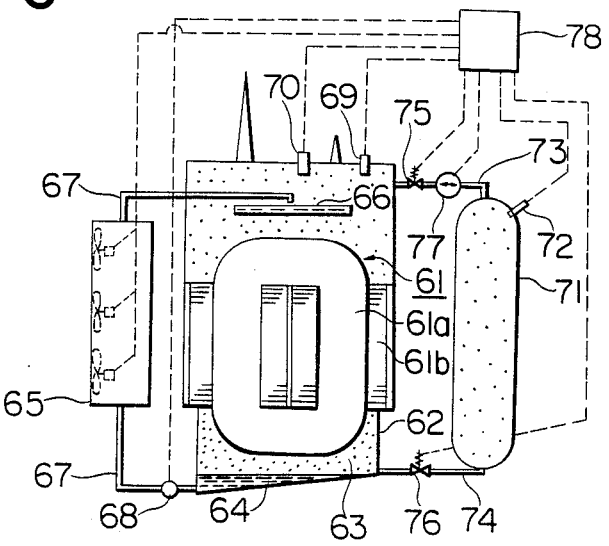
FIG. 6 is a modified embodiment of the present invention.

FIG. 6 shows a modified embodiment of the present invention. In the drawing, the numeral 61 designates a transformer having a winding 61*a* and an iron core 61*b*. The numeral 62 designates a tank, the numeral 63 a gas mixture consisting essentially of a non-condensable gas and a condensable gas. The numeral 64 designates a liquid phase of the condensable gas. The numeral 65 designates a liquid cooler, the numeral 66 a spray nozzle, the numeral 67 a piping, the numeral 68 a pump, the numeral 69 a pressure sensor, the numeral 70 a temperature sensor, the numeral 71 a gas reservoir, and the numeral 72 a pressure sensor. The numerals 73, 74 designate piping and the numerals 75, 76 control valves. The numeral 77 designates a compressor and the numeral 78 a control unit.

During standstill or non-load or light-load operation of the above described gas-insulated transformer of the present invention, the operation is similar to that of the conventional device. When the transformer is started or when a larger load is placed on the transformer, the temperature of the gas mixture 63 and the liquid 69 is elevated due to heat evolved from the winding 61*a* and the iron core 61*b* so that the gas pressure of the gas mixture 63 is increased.

In the above described embodiment of the present invention, the temperature of the gas mixture 63 in the tank 62 is sensed by the temperature senser 70. The gas pressure in the tank 62 is not controlled until such time the temperature reaches a preset value. In other words, control is made in connection with the tank 62 operating in a closed system. It is however required that the gas pressure brought about by the expansion of the gas mixture 63 and the evaporation of the liquid 64 be maintained at this time within a range between a preset lower value and a preset upper value at the aforementioned preset temperature. When the temperature of the gas mixture 63 is higher than the preset value, the pressure within the tank 62 and that within the gas reservoir 71 are sensed by pressure sensors 69, 72, respectively. The control unit 78 then operates to transfer the gas mixture 63 from the tank 62 into the gas reservoir 71 by actuating the compressor 77 and the control valves 75 or 76 so that the gas pressure in the tank 62 may be maintained within the preset range.

When the load on the transformer is lowered, the temperature of the gas mixture 63 and the liquid 64 is lowered because less heat is evolved from the winding 61*a* and the iron core 61*b*. For preventing the dielectric strength of the winding 61*a* from being lowered as a result of such decrease in the gas pressure, the pressure within tank 62 and the gas reservoir 71 are sensed by pressure sensors 69, 72, respectively in the same way as in the conventional system. Based on the thus sensed pressure values, the control unit 78 operates to return the gas mixture 62 and the liquid 64 from the gas reservoir 71 into the tank 62 upon actuation of the compressor 77 and the control valves 75 or 76 in the same way as in the conventional system. The above described reversible control operation is performed as long as the temperature sensed by the temperature senser 70 is higher than the preset temperature. The control operation is discontinued when the temperature of the gas mixture 63 is lowered to the preset valve. For temperatures lower than said preset value, the control valves 75, 76 are closed so that the tank 62 operates in a closed system.

In the present embodiment, the pressure control operation is performed in this manner for the temperature of the gas mixture 4 higher than the preset value. The critical temperature for such pressure control is so selected that the temperature is the highest possible temperature and that the vapor pressure of the condensable gas at such temperature is negligible small as compared to the pressure of the non-condensable gas.

It is well-known that the dielectric strength of the non-condensable electrically negative gas such as $SF_6$ depends on the number of molecules in a unit volume and remains unaffected appreciably by changes in temperature or pressure. Thus the dielectric strength may be maintained at the value prevailing at the time of sealing even if the gas pressure or temperature in tank 62 be lowered after sealing off the tank 62, because the number of molecules of the non-condensable gas is not changed from the value prevailing at the time of sealing. Thus, insofar as the aforementioned control is performed, a sufficient dielectric strength may be maintained when the transformer is operated under no-load or light-load conditions or restarted after dwell time.

For a temperature range in which to perform the pressure control as mentioned above, the number of molecules of the non-condensable gas in the tank 62 becomes lower than that at the temperature at which the pressure control is discontinued, because the gas mixture 63 need be transferred from the tank 62 into the gas reservoir 71. However, the number of molecules of the condensable gas is increased due to the rise in the vapor pressure of the liquid 64.

Thus, when the $SF_6$ gas, for example, is used as non-condensable gas and fluorocarbon $C_8F_{16}O$, for example, is used as refrigerant, the dielectric strength of the gas mixture is not lowered, but tends to be raised, even if the gas mixture is transferred from the tank 62 into the gas reservoir 71. It is because the dielectric strength of the gaseous phase of the $C_8F_{16}O$ is sufficiently higher than (usually about twice) that of the $SF_6$ gas at the same pressure.

In addition, the vapor pressure of the fluorocarbon $C_8F_{16}O$ is equal for example to 0.05 kg/cm$^2$ abs. at 20° C., which is substantially negligible as compared to the gas pressure of the $SF_6$ gas higher than 1 kg/cm abs. at which the gas is usually sealed into the system. Thus the fluorocarbon may be used conveniently as refrigerant in that it enables the critical gas pressure control temperature to be set to a moderately higher value.

Figure 7:
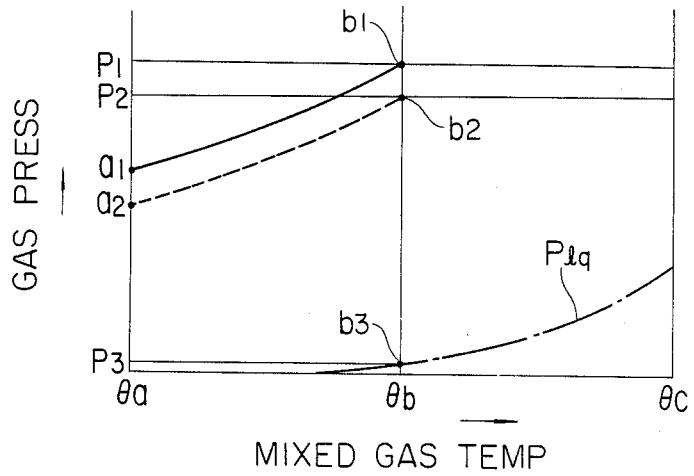
FIG. 7 shows the operating characteristics for the inventive pressure control system and the conventional system.

FIG. 7 shows the operating characteristics for the inventive pressure control system and the comparable conventional system. In this figure, the temperature of the gas mixture 63 in the tank 62 is plotted on the abscissa. $\theta_a$ designates the lowest working temperature, $\theta_b$ the critical gas pressure control temperature and $\theta_c$ the highest working temperature. In FIG. 7, the gas pressure in tank 62 is plotted on the ordinate. In the conventional system, the pressure is controlled within a range between a specified upper pressure $P_1$ and a specified lower pressure $P_2$ for the overall range of the working temperature. In the inventive system, since the pressure control is not performed for the temperature range $\theta_a$–$\theta_b$, the gas pressure is changed within a range confined by an upper limit curve $a_1b_1$ and a lower limit curve $a_2b_2$. For the temperature range $\theta_b$–$\theta_c$, the pressure is controlled to be within $P_1$ and $P_2$, as in the conventional system. In the drawing, curve $P_{lg}$ denotes the vapor pressure of the liquid 64.

Since the pressure is not controlled in the present invention for temperature $\theta_a$–$\theta_b$, the amount of gas corresponding to such range of temperature is not required. For example, with $\theta_a$ equal to −20° C. (the lowest working temperature for outdoor transformers, Nippon Denki Gakkai Standards, JEC 204) and $\theta_b$ equal to 80° C., it is required that, at $\theta_a$, an amount equal to $$\left(\frac{273+30}{273-20}-1\right)\times 100 = 20 \text{ percent more of the}$$

non-condensable gas be sealed in the tank 62 than the amount

-continued of the gas sealed at $\theta_0$.

Thus, in the present device, the amount of gas to be transferred between the tank 62 and the reservoir 71 is reduced, with various advantages such as reduced size of the tank 71 and reduced capacity of the compressor 77.

Figure 8:
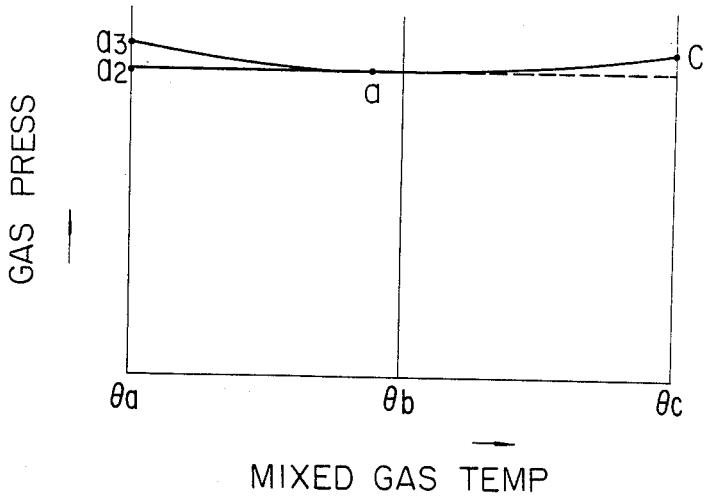
FIG. 8 shows dielectric strength characteristics of the inventive system and the comparable conventional system.

FIG. 8 shows dielectric strength characteristics of the inventive system and the comparable conventional system. In the latter system, because excess gas is sealed for $\theta_a$–$\theta_b$, its dielectric strength characteristics are shown by a V-shaped curve $a_3$–dc with point d as minimum value. In contrast thereto, dielectric strength characteristics of the inventive system exhibit a more flat curve $a_4$–dc devoid of useless portions proper to the characteristic curve of the conventional system.

The control unit 78 is preferably so designed that, in case of temperature decrease of the gas mixture 63, the gas pressure is elevated at the critical pressure control temperature $\theta_b$ to the upper pressure $P_1$ (point $b_1$), after which the pressure control operation is discontinued. In this case, the ensuing pressure change follows the curve $a_1$–$b_1$. Thus the decrease in the dielectric strength caused by the vapor pressure of the liquid 64 being decreased further from the small value $P_3$ (point $b_3$) at $\theta_b$ may be compensated and a larger dielectric strength may be assured than that obtained when the pressure decrease follows the curve $a_2$–$b_2$.

Although the foregoing description has been made of the gas-insulated transformer, it is to be noted that the present invention may also be applied to any other electro-magnetic induction devices, such as gas-insulated reactors. In addition, the present invention is not limited to the case of sensing the temperature of the gas mixture 63, but may be applied to sensing the temperature of the liquid 64, in which case the control operation may be performed similarly to that described above.

From the foregoing it is seen that the arrangement of the present invention provides a gas-insulated electrical apparatus in which the pressure and the temperature of the gas mixture in the tank are sensed and pressure control is performed for a temperature higher than a preset value, thus enabling the dielectric strength to be maintained at an acceptable level for a lesser amount of the insulating gas and the capacity of the gas reservoir and that of the compressor to be reduced advantageously.

What is claimed is:

1. A gas-insulated electrical apparatus comprising a tank housing an electrical apparatus in which a gas mixture, consisting essentially of a noncondensable insulating gas and a condensable refrigerant gas, and a liquid phase of the condensable refrigerant gas are sealed, a gas reservoir connected to said tank in gas mixture feeding and receiving relation therewith, and conveying means for keeping the pressure in the tank between preset upper and lower limits irrespective of the pressure in the gas reservoir including means for supplying a gas mixture in mutually opposite directions under pressure between said tank and the gas reservoir for selectively supplying said gas mixture from said tank into said gas reservoir or from said gas reservoir into said tank.

2. The apparatus as claimed in claim 1 wherein said conveying means includes a reversible compressor.

3. The apparatus as claimed in claim 1 wherein said conveying means comprises a first compressor and a second compressor adapted for supplying said gas mixture under pressure in mutually opposite directions.

4. The apparatus as claimed in claim 1 wherein said conveying means includes a compressor adapted for supplying said gas mixture only in one direction and associated with a control valve on one side and another control valve on the other side thereof, a third control valve bypassing said one-side control valve and the compressor, and a fourth control valve bypassing said other-side control valve and the compressor.

5. A gas-insulated electrical apparatus comprising a tank housing an electrical apparatus in which a gas mixture, consisting essentially of a noncondensable insulating gas and a condensable refrigerant gas, and a liquid phase of the condensable refrigerant gas are sealed, a gas reservoir connected to said tank in gas mixture feeding and receiving relation therewith, and conveying means for keeping the pressure in the tank between preset upper and lower limits irrespective of the pressure in the gas reservoir including means for supplying a gas mixture in mutually opposite directions under pressure between said tank and the gas reservoir for selectively supplying said gas mixture from said tank into said gas reservoir or from said gas reservoir into said tank, a pressure sensor for sensing the pressure within said tank, a temperature sensor for sensing the temperature of the gas mixture of said insulating gas and said refrigerant gas turned into the gaseous phase through evaporation, and control means for controlling the pressure in said tank to be within a preset pressure range through operation of said conveying means, said control means being so set that pressure control is performed for the temperature of the gas mixture in said tank which is higher than a preset lower value and lower than a preset higher value.

6. The apparatus as claimed in claim 5 wherein said control means is so set that, during decrease of the gas mixture temperature, the gas pressure is adjusted to the upper limit of the pressure control range of said control means at the critical pressure control temperature, and the pressure control operation is terminated when the gas mixture is lowered to the preset value so that the gas reservoir and tank operate in a closed system.

7. The apparatus as claimed in claim 5 wherein $SF_6$ gas is used as said insulating gas and fluorocarbon $C_8F_{16}O$ is used as said refrigerant gas.

* * * * *